US008881961B1

(12) United States Patent
Cibirka

(10) Patent No.: US 8,881,961 B1
(45) Date of Patent: Nov. 11, 2014

(54) MOBILE ELECTRONIC DEVICE CARRIER ASSEMBLY

(76) Inventor: Antanas V. Cibirka, Tinley Park, IL (US)

( * ) Notice: Subject to any disclaimer, the term of this patent is extended or adjusted under 35 U.S.C. 154(b) by 118 days.

(21) Appl. No.: 13/490,544

(22) Filed: Jun. 7, 2012

(51) Int. Cl.

| | |
|---|---|
| ***A45F 3/00*** | (2006.01) |
| ***A45C 13/30*** | (2006.01) |
| ***A45F 3/02*** | (2006.01) |
| ***A63B 55/00*** | (2006.01) |
| ***A45F 3/10*** | (2006.01) |
| ***A41D 27/26*** | (2006.01) |

(52) U.S. Cl.
USPC ..... 224/265; 224/623; 224/201; 224/600; 224/604; 2/268

(58) Field of Classification Search
USPC ..... 224/623, 201, 600, 604, 265; 2/268
IPC ..... A45F 3/14
See application file for complete search history.

(56) References Cited

U.S. PATENT DOCUMENTS

| | | | | | |
|---|---|---|---|---|---|
| 2,636,822 | A * | 4/1953 | Anderson | 224/185 |
| 2,945,428 | A * | 7/1960 | Dearborn | 396/421 |
| 3,541,976 | A * | 11/1970 | Rozas | 108/43 |
| 3,661,308 | A * | 5/1972 | Walters | 224/258 |
| 4,177,967 | A * | 12/1979 | Marchus | 248/229.1 |
| 4,526,308 | A * | 7/1985 | Dovey | 224/265 |
| 4,715,293 | A * | 12/1987 | Cobbs | 108/43 |
| 5,598,963 | A * | 2/1997 | Buswell | 224/664 |
| 5,806,734 | A * | 9/1998 | Scott | 224/265 |
| 5,890,025 | A * | 3/1999 | Hart | 396/420 |
| 6,359,609 | B1 * | 3/2002 | Kuenster et al. | 345/156 |
| 6,662,986 | B2 | 12/2003 | Lehtonen | |
| 6,721,579 | B2 | 4/2004 | Liu | |
| 6,764,231 | B1 * | 7/2004 | Shubert | 396/419 |
| 7,174,196 | B2 | 2/2007 | Matsuda | |
| D583,365 | S | 12/2008 | Suk et al. | |
| 7,551,458 | B2 * | 6/2009 | Carnevali | 361/807 |
| 7,681,855 | B1 * | 3/2010 | Cashman et al. | 248/441.1 |
| 2002/0043545 | A1 | 4/2002 | Tang | |
| 2004/0056061 | A1 | 3/2004 | Yang | |
| 2007/0164987 | A1 * | 7/2007 | Graham | 345/156 |
| 2008/0173681 | A1 * | 7/2008 | Robinson | 224/257 |
| 2011/0297711 | A1 * | 12/2011 | Yu et al. | 224/272 |
| 2011/0315733 | A1 * | 12/2011 | White | 224/600 |
| 2013/0214022 | A1 * | 8/2013 | Harvey | 224/623 |

* cited by examiner

*Primary Examiner* — Brian D Nash
*Assistant Examiner* — Derek Battisti

(57) ABSTRACT

A mobile electronic device carrier assembly includes a bracket that has a first arm, a second arm and a middle arm. The middle arm is coupled to and extends between each of the first and second arms. Each of the first and second arms has an adjustable length. The bracket has a U-shape so the first and second arms of the bracket are spaced apart. A collar is pivotally coupled to and extends between a free end of each of the first and second arms of the bracket. The collar may be positioned around a back of a user's neck so the bracket may be directed downwardly along the user's chest. A support is coupled to the middle arm of the bracket. A mount is coupled to the support. The mount may receive a mobile electronic device so the mount provides hands-free operation of the mobile electronic device.

10 Claims, 3 Drawing Sheets

MOBILE ELECTRONIC DEVICE CARRIER ASSEMBLY

BACKGROUND OF THE DISCLOSURE

Field of the Disclosure

The disclosure relates to mobile electronic device carrier assemblies and more particularly pertains to a new mobile electronic device carrier assembly for providing hands-free use of the mobile electronic device.

SUMMARY OF THE DISCLOSURE

An embodiment of the disclosure meets the needs presented above by generally comprising a bracket that has a first arm, a second arm and a middle arm. The middle arm is coupled to and extends between each of the first and second arms. Each of the first and second arms has an adjustable length. The bracket has a U-shape so the first and second arms of the bracket are spaced apart from each other. A collar is pivotally coupled to and extends between a free end of each of the first and second arms of the bracket. The collar may be positioned around a back of a user's neck so the bracket may be directed downwardly along the user's chest. A support is coupled to the middle arm of the bracket. A mount is coupled to the support. The mount may receive a mobile electronic device so the mount provides hands-free operation of the mobile electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
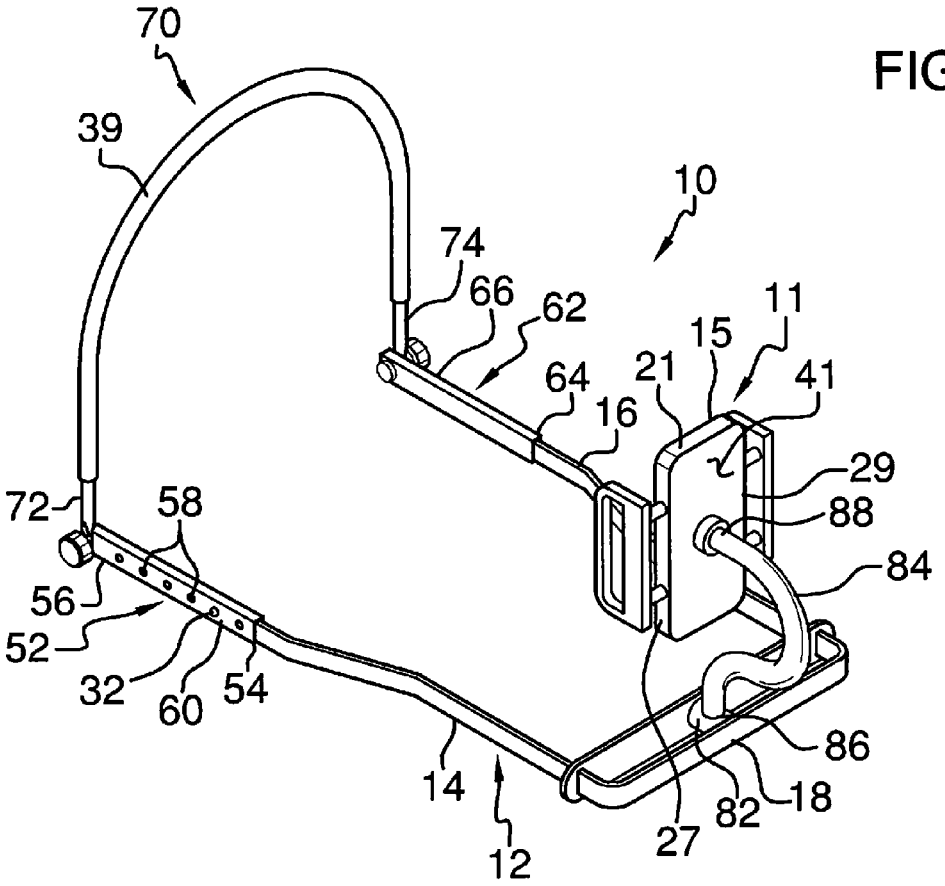
FIG. 1 is a perspective view of a mobile electronic device carrier assembly according to an embodiment of the disclosure.
Figure 2:
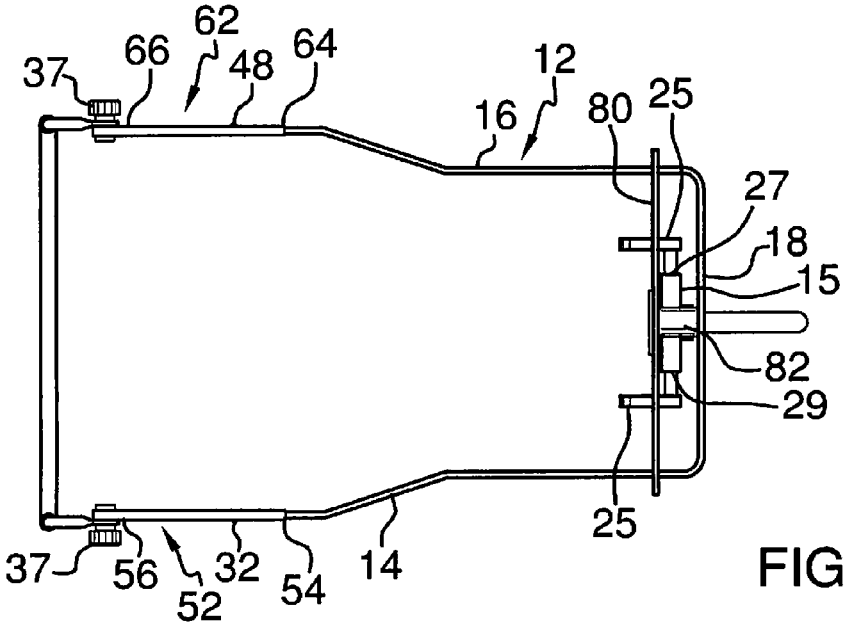
FIG. 2 is a bottom view of an embodiment of the disclosure.
Figure 3:
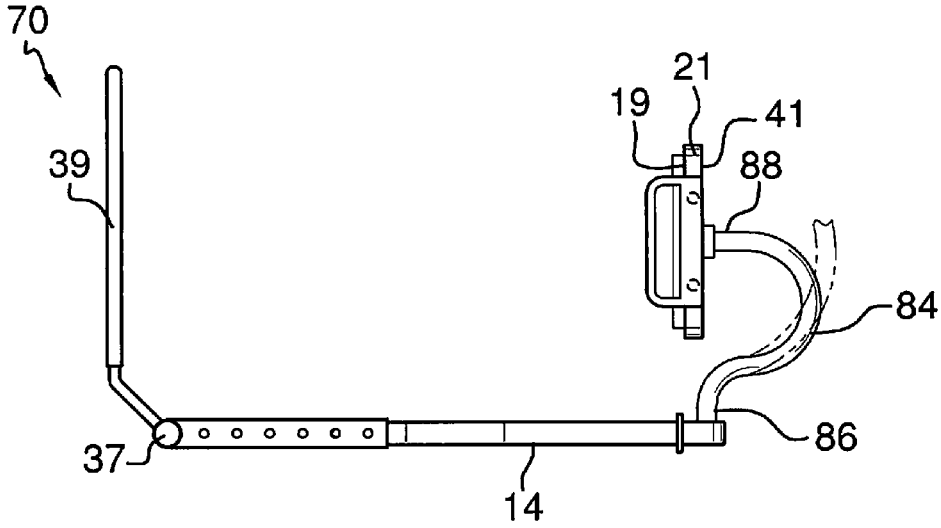
FIG. 3 is a right side view of an embodiment of the disclosure.
Figure 4:
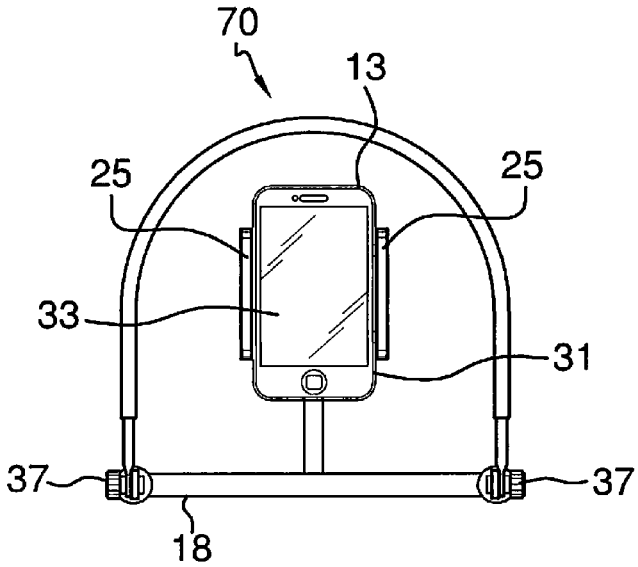
FIG. 4 is a back view of an embodiment of the disclosure.
Figure 5:
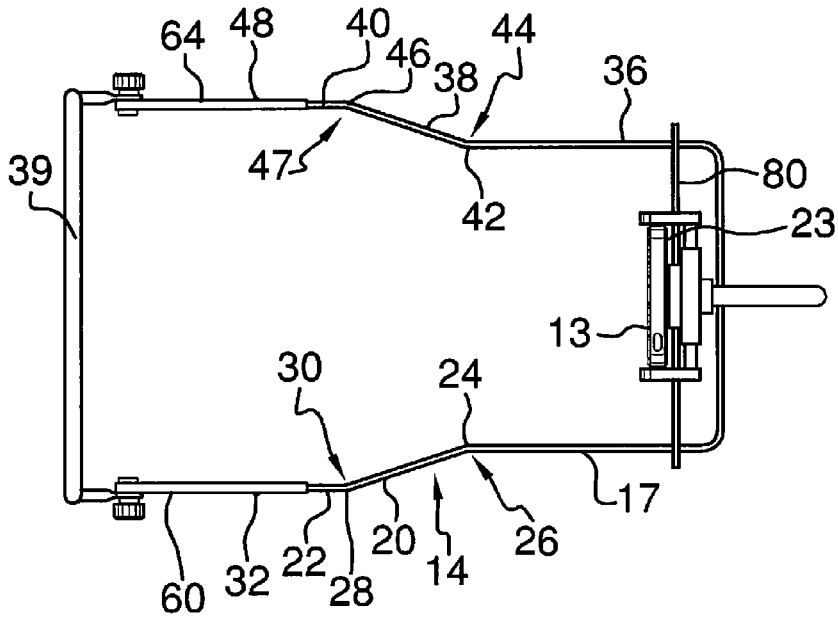
FIG. 5 is a top view of an embodiment of the disclosure.
Figure 6:
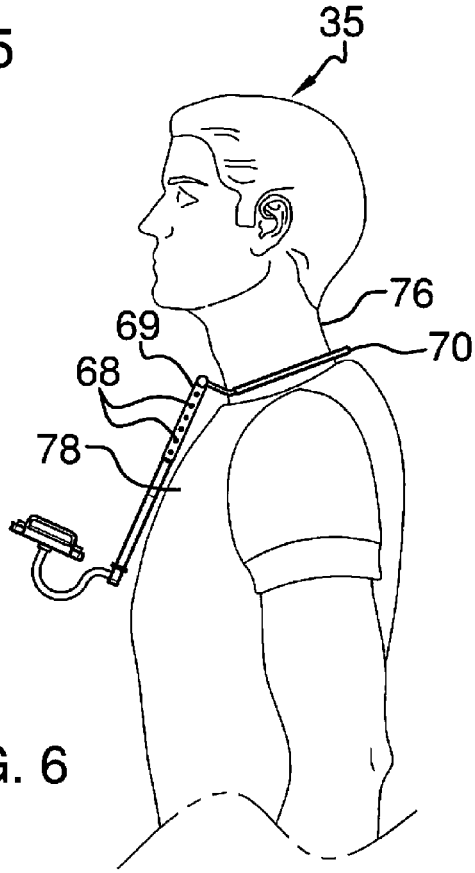
FIG. 6 is an in-use view of an embodiment of the disclosure.

With reference now to the drawings, and in particular to FIGS. 1 through 6 thereof, a new mobile electronic device carrier assembly embodying the principles and concepts of an embodiment of the disclosure and generally designated by the reference numeral 10 will be described.

As best illustrated in FIGS. 1 through 6, the mobile electronic device carrier assembly 10 generally comprises a bracket 12 that has a first arm 14, a second arm 16 and a middle arm 18. The middle arm 18 is coupled to and extends between each of the first 14 and second arms 16. Each of the first 14 and second 16 arms has an adjustable length. The bracket 12 has a U-shape so the first 14 and second 16 arms of the bracket 12 are spaced apart from each other. Each of the first 14 and second 16 arms may have a length between 10 cm and 15 cm.

The first arm 14 of the bracket 12 includes a first portion 17, a middle portion 20 and an end portion 22. The first arm 14 has a first bend 24 positioned between the first 17 and middle 20 portions of the first arm 14 so the first 17 and middle 20 portions of the first arm 14 form an obtuse first angle 26. The first arm 14 has a second bend 28 positioned between the middle 20 and end 22 portions of the first arm 14 so the middle 20 and end 22 portions of the first arm 14 form an obtuse second angle 30. The obtuse second angle 30 of the first arm 14 is congruent with the obtuse first angle 26 of the first arm 14. A first retainer 32 is resiliently coupled to the first arm 14 proximal a free end 34 of the first arm 14. The first arm 14 may be comprised of a rigid material.

The second arm 16 of the bracket has a first portion 36, a middle portion 38 and an end portion 40. The second arm 16 has a first bend 42 positioned between the first 36 and middle 38 portions of the second arm 16 so the first 36 and middle 38 portions of the second arm 16 forms an obtuse first angle 44. The second arm 16 has a second bend 46 positioned between the middle 38 and end 40 portions of the second arm 16 so the middle 38 and end 40 portions of the second arm 16 form an obtuse second angle 47. The obtuse second angle 47 of the second arm 16 is congruent with the obtuse first angle 44 of the second arm 16. A second retainer 48 is resiliently coupled to the second arm 16 proximal a free end 50 of the second arm 16. The second arm 16 may be comprised of a rigid material.

A first coupler 52 has an open end 54 and a closed end 56. The first coupler 52 has a plurality of first retainer apertures 58 extending through an exterior side 60 of the first coupler 52. The open end 56 of the first coupler insertably receives the free end 34 of the first arm 14 so the first coupler 52 may selectively adjust a length of the first arm 14. A selected one of the first retainer apertures 58 insertably receives the first retainer 32 so the first coupler 52 is retained at the selected length. The first coupler 52 may increase the length of the first arm 14 between 16.5 cm and 21.5 cm.

A second coupler 62 has an open end 64 and a closed end 66. The second coupler 62 has a plurality of second retainer apertures 68 extending through an exterior side 69 of the second coupler 62. The open end 64 of the second coupler 62 insertably receives the free end 50 of the second arm 16 so the second coupler 62 may selectively adjust a length of the second arm 16. A selected one of the second retainer apertures 68 insertably receives the second retainer 48 so the second coupler 62 is retained at the selected length. The second coupler 62 may increase the length of the second arm 16 between 16.5 cm and 21.5 cm.

A collar 70 has a first end 72 and a second end 74. The collar 70 has a U-shape so the first 72 and second ends 74 of the collar 70 are spaced apart from each other. The first end 72 of the collar 70 is pivotally coupled to the closed end 56 of the first coupler 52. The second end 74 of the collar 70 is pivotally coupled to the closed end 66 of the second coupler 62. The collar 70 may be worn around a back of the user's neck 76 so the bracket 12 is directed downwardly along the user's chest 78. The collar 70 may have a length between 51 cm and 56 cm.

A connecting bar 80 is coupled to and extends between each of the first 14 and second 16 arms of the bracket 12. The connecting bar 80 may have a length between 10 cm and 12.5 cm. The connecting bar 80 is positioned proximal the middle arm 18 of the bracket 12. A tab 82 is coupled to and extends between a central point 84 of the connecting bar 80 and the middle arm 18 of the bracket 12. The tab 82 may have a length between 2.5 cm and 4 cm.

A support 84 has a first end 86 and a second end 88. The first end 86 of the support 84 is coupled to the tab 82. The support 84 extends upwardly from the tab 82. The support 84 is flexible so the second end 88 of the support is positionable in a plurality of positions in relation to the first end 86 of the support 84. A mount 11 is coupled to the support 84. The mount 11 may receive a mobile electronic device 13 so the mount 11 provides hands-free operation of the mobile electronic device 13.

The mount 11 includes a primary wall 15 that has a rear surface 41, a front surface 19 and a perimeter edge 21. The rear surface 41 of the primary wall 15 is coupled to the second end 88 of the support 84 so the mount 11 is positionable in a plurality of positions. The primary wall 15 may have a length between 10 cm and 12.5 cm and a width between 5 cm and 7.5 cm. The mobile electronic device 13 may be positioned in the mount 11 so a back side 23 of the mobile electronic device 13 abuts the front surface 19 of the primary wall 15.

A pair of retainers 25 each is slidably coupled to an associated one of a first lateral side 27 and a second lateral side 29 of the perimeter edge 21 of the primary wall 15. Each of the retainers 25 is adjustably positionable to abut an exterior edge 31 of the mobile electronic device 13 so the retainers 25 may abut and frictionally retain the mobile electronic device 13 in the mount 11. The mount 11 may retain the mobile electronic device 13 so a display 33 on the mobile electronic device 13 may be observed by the user 35.

A pair of fasteners 37 extends through an associated one of the first 72 and second 74 ends of the collar 70. Each of the fasteners 37 threadably engages an associated one of the closed ends 56, 66 of the first 52 and second 62 couplers so the collar 70 is retained in a selected position. A sleeve 39 is positioned around the collar 70 so the sleeve 39 extends from the first end 72 of the collar 70 to the second end 74 of the collar 70. The sleeve 39 may be comprised of a resiliently compressible material. The sleeve 39 abuts the back of the user's neck 76 when the collar 70 is worn by the user 35 so the sleeve 39 may provide comfort for the user 35.

In use, after the collar 70 is positioned on the user 35 the fasteners 37 may be manipulated so the bracket 12 is positioned to extend downwardly along the user's chest 78. The fasteners may be manipulated so the bracket 12 extends outwardly from the user's chest 78. Once the mobile electronic device 13 is retained in the mount 11 the support 84 may be manipulated to position the mobile electronic device 13 in a desired position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A mobile electronic device carrier assembly comprising:

a bracket having a first arm, a second arm and a middle arm, said middle arm being coupled to and extending between each of said first and second arms, each of said first and second arms having an adjustable length, said bracket having a U-shape whereby said first and second arms of said bracket are spaced apart from each other;

a collar being pivotally coupled to and extending between a free end of each of said first and second arms of said bracket, whereby said collar is configured to be positioned around a back of a user's neck whereby said bracket is configured to be directed downwardly along the user's chest;

a support coupled to said middle arm of said bracket and being spaced from said first and second arms;

a mount coupled to said support, said mount being configured for receiving a mobile electronic device such that said mount provides hands-free operation of the mobile electronic device;

a connecting bar coupled to and extending between each of said first and second arms of said bracket, said connecting bar being positioned proximal said middle arm of said bracket;

a tab directly coupled to and extending between a central point of said connecting bar and said middle arm of said bracket;

said support comprising a singular unitary post having a first end and a second end, said first end of said support being coupled to said tab, said support being flexible whereby said second end of said support is positionable in a plurality of positions in relation to said first end of said support;

said mount including a primary wall having a rear surface, a front surface and a perimeter edge, said rear surface of said primary wall being coupled to said second end of said support whereby said mount is positionable in a plurality of positions relative to said tab.

2. The assembly according to claim 1, further including said first arm of said bracket having a first portion, a middle portion and an end portion, said first arm having a first bend positioned between said first and middle portions of said first arm whereby said first and middle portions of said first arm forms an obtuse first angle, said first arm having a second bend positioned between said middle and end portions of said first arm whereby said middle and end portions of said first arm forms an obtuse second angle, said obtuse second angle of said first arm being congruent with said obtuse first angle of said first arm.

3. The assembly according to claim 1, further including said second arm of said bracket having a first portion, a middle portion and an end portion, said second arm having a first bend positioned between said first and middle portions of said second arm whereby said first and middle portions of said second arm forms an obtuse first angle, said second arm having a second bend positioned between said middle and end portions of said second arm whereby said middle and end portions of said second arm forms an obtuse second angle, said obtuse second angle of said second arm being congruent with said obtuse first angle of said second arm.

4. The assembly according to claim 1, further including a first coupler having an open end and a closed end, said open end of said first coupler insertably receiving a free end of said first arm whereby said first coupler is configured to selectively adjust a length of said first arm.

5. The assembly according to claim 1, further including a second coupler having an open end and a closed end, said open end of said second coupler insertably receiving a free end of said second arm whereby said second coupler is configured to selectively adjust a length of said second arm.

6. The assembly according to claim 1, further including:

a first coupler having an open end and a closed end;

a second coupler having an open end and a closed end;

said collar having a first end and a second end, said collar having a U-shape whereby said first and second ends of said collar are spaced apart from each other, said first end of said collar being pivotally coupled to said closed end of said first coupler, said second end of said collar being pivotally coupled to said closed end of said second coupler.

7. The assembly according to claim 1, further including said mount including a pair of retainers each being slidably coupled to an associated one of a first lateral side and a second lateral side of said perimeter edge of said primary wall, each of said retainers being adjustably positionable to abut an exterior edge of the mobile electronic device whereby said retainers are configured to abut and frictionally retain the mobile electronic device in said mount.

8. The assembly according to claim 6, further including a pair of fasteners extending through an associated one of said first and second ends of said collar, each of said fasteners threadably engaging an associated one of said closed ends of said first and second couplers whereby said collar is retained in a selected position.

9. The assembly according to claim 6, further including a sleeve positioned around said collar such that said sleeve extends from said first end of said collar to said second end of said collar, said sleeve being comprised of a resiliently compressible material, said sleeve abutting the back of the user's neck when said collar is worn by the user whereby said sleeve is configured to provide comfort for the user.

10. A mobile electronic device carrier assembly comprising:

a bracket having a first arm, a second arm and a middle arm, said middle arm being coupled to and extending between each of said first and second arms, each of said first and second arms having an adjustable length, said bracket having a U-shape whereby said first and second arms of said bracket are spaced apart from each other, said first arm of said bracket including a first portion, a middle portion and an end portion, said first arm having a first bend positioned between said first and middle portions of said first arm whereby said first and middle portions of said first arm forms an obtuse first angle, said first arm having a second bend positioned between said middle and end portions of said first arm whereby said middle and end portions of said first arm forms an obtuse second angle, said obtuse second angle of said first arm being congruent with said obtuse first angle of said first arm, said second arm of said bracket having a first portion, a middle portion and an end portion, said second arm having a first bend positioned between said first and middle portions of said second arm whereby said first and middle portions of said second arm forms an obtuse first angle, said second arm having a second bend positioned between said middle and end portions of said second arm whereby said middle and end portions of said second arm forms an obtuse second angle, said obtuse second angle of said second arm being congruent with said obtuse first angle of said second arm;

a first coupler having an open end and a closed end, said open end of said first coupler insertably receiving a free end of said first arm whereby said first coupler is configured to selectively adjust a length of said first arm;

a second coupler having an open end and a closed end, said open end of said second coupler insertably receiving a free end of said second arm whereby said second coupler is configured to selectively adjust a length of said second arm;

a collar having a first end and a second end, said collar having a U-shape whereby said first and second ends of said collar are spaced apart from each other, said first end of said collar being pivotally coupled to said closed end of said first coupler, said second end of said collar being pivotally coupled to said closed end of said second coupler, whereby said collar is configured to be worn around a back of the user's neck whereby said bracket is configured to be directed downwardly along the user's chest;

a connecting bar coupled to and extending between each of said first and second arms of said bracket, said connecting bar being positioned proximal said middle arm of said bracket;

a tab directly coupled to and extending between a central point of said connecting bar and said middle arm of said bracket;

a support having a first end and a second end, said first end of said support being coupled to said tab, said support being flexible whereby said second end of said support is positionable in a plurality of positions in relation to said first end of said support;

a mount coupled to said support, said mount being configured for receiving a mobile electronic device such that said mount provides hands-free operation of the mobile electronic device, said mount including;

a primary wall having a rear surface, a front surface and a perimeter edge, said rear surface of said primary wall being coupled to said second end of said support whereby said mount is positionable in a plurality of positions;

a pair of retainers each being slidably coupled to an associated one of a first lateral side and a second lateral side of said perimeter edge of said primary wall, each of said retainers being adjustably positionable to abut an exterior edge of the mobile electronic device whereby said retainers are configured to abut and frictionally retain the mobile electronic device in said mount;

a pair of fasteners extending through an associated one of said first and second ends of said collar, each of said fasteners threadably engaging an associated one of said closed ends of said first and second couplers whereby said collar is retained in a selected position; and a sleeve positioned around said collar such that said sleeve extends from said first end of said collar to said second end of said collar, said sleeve being comprised of a resiliently compressible material, said sleeve abutting the back of the user's neck when said collar is worn by the user whereby said sleeve is configured to provide comfort for the user.

* * * * *